US008783413B1

(12) United States Patent
Thawani et al.

(10) Patent No.: US 8,783,413 B1
(45) Date of Patent: Jul. 22, 2014

(54) TUNED SHUNT TUBES FOR CLIMATE CONTROL AIR-HANDLING SYSTEMS

(71) Applicant: DENSO International America, Inc., Southfield, MI (US)

(72) Inventors: Prakash T. Thawani, Bloomfield Hills, MI (US); Steve Sinadinos, Commerce Township, MI (US); Justin Black, Novi, MI (US)

(73) Assignee: DENSO International America, Inc., Southfield, MI (US)

( * ) Notice: Subject to any disclaimer, the term of this patent is extended or adjusted under 35 U.S.C. 154(b) by 0 days.

(21) Appl. No.: 13/799,053

(22) Filed: Mar. 13, 2013

(51) Int. Cl.
*F24F 13/24* (2006.01)

(52) U.S. Cl.
CPC ..... *F24F 13/24* (2013.01)
USPC ..... 181/224; 181/253

(58) Field of Classification Search
USPC ..... 181/224, 225, 226, 253
See application file for complete search history.

(56) References Cited

U.S. PATENT DOCUMENTS

| | | | | |
|---|---|---|---|---|
| 1,591,088 | A * | 7/1926 | Holmes | 181/251 |
| 2,027,359 | A * | 1/1936 | Wood et al. | 181/264 |
| 3,323,305 | A * | 6/1967 | Klees | 60/469 |
| 3,568,791 | A * | 3/1971 | Luxton | 181/224 |
| 3,951,566 | A * | 4/1976 | Mattei et al. | 415/115 |
| 5,033,581 | A * | 7/1991 | Feuling | 181/257 |
| 6,633,646 | B1 * | 10/2003 | Hwang | 381/71.5 |
| 6,772,858 | B2 | 8/2004 | Trochon | |
| 7,017,707 | B2 | 3/2006 | Zia et al. | |
| 7,059,146 | B2 | 6/2006 | Nakajima | |
| 7,117,973 | B2 * | 10/2006 | Graefenstein | 181/253 |
| 7,416,051 | B2 | 8/2008 | Byrne et al. | |
| 7,497,300 | B2 * | 3/2009 | D'Angelo | 181/241 |
| 7,946,383 | B2 * | 5/2011 | Lynch | 181/250 |
| 8,146,706 | B2 * | 4/2012 | Katoh et al. | 181/224 |
| 2004/0060287 | A1 | 4/2004 | Campbell | |
| 2008/0233856 | A1 * | 9/2008 | Okawa et al. | 454/143 |
| 2010/0111713 | A1 | 5/2010 | Chatfield et al. | |

* cited by examiner

*Primary Examiner* — Jeremy Luks

(74) *Attorney, Agent, or Firm* — Harness, Dickey & Pierce, P.L.C.

(57) ABSTRACT

The present teachings provide for an airflow sound suppressor, such as for an HVAC assembly, for example. The sound suppressor includes a first end configured to be mounted to a first surface of the HVAC assembly. A second end of the sound suppressor is configured to be mounted to a second surface of the HVAC assembly. An elongated portion extends between the first end and the second end. The elongated portion defines a passageway therethrough that extends an entire length of the sound suppressor.

15 Claims, 2 Drawing Sheets

TUNED SHUNT TUBES FOR CLIMATE CONTROL AIR-HANDLING SYSTEMS

FIELD

The present disclosure relates to tuned shunt tubes for climate control air-handling systems.

BACKGROUND

This section provides background information related to the present disclosure, which is not necessarily prior art.

Heating, ventilation, and air cooling (HVAC) assemblies and systems include, for example, a blower scroll, inlet and outlet ducts, irregular shaped chambers and cavities, and non-uniform cross-section ducts with registers and restrictive heat exchangers, such as heater cores and evaporators. As airflow passes through such HVAC systems and assemblies, various noises may occur, such as hollow tones between about 500 Hz. to about 1500 Hz. Because only a small space is available under the HVAC assembly for the instrument panel, conventional noise control approaches using, for example, mufflers and/or sound absorbers can be costly and can negatively affect airflow performance. Sound suppressing devices and methods that selectively target and suppress sounds caused by airflow flowing through an HVAC assembly without sacrificing airflow strength and heating/cooling performance would thus be desirable.

SUMMARY

This section provides a general summary of the disclosure, and is not a comprehensive disclosure of its full scope or all of its features.

The present teachings provide for an airflow sound suppressor. The sound suppressor includes a first end configured to be mounted to a first surface. A second end of the sound suppressor is configured to be mounted to a second surface. An elongated portion extends between the first end and the second end. The elongated portion defines a passageway therethrough that extends an entire length of the sound suppressor.

The present teachings further provide for a sound suppressor for a heating, ventilation, and air cooling (HVAC) assembly including a first end mounted to the HVAC assembly at a first aperture defined by the HVAC assembly. A second end of the sound suppressor is mounted to the HVAC assembly at a second aperture defined by the HVAC assembly spaced apart from the first aperture. A flexible elongated portion extends from the first end to the second end. The flexible elongated portion defines a passageway therethrough extending an entire length of the sound suppressor.

The present teachings also provide for a method for suppressing a target sound of an airflow assembly. The method includes: selecting a flexible sound suppressor tube defining an airflow passageway from a plurality of flexible sound suppressor tubes having different dimensions based on location and frequency of the target sound to be suppressed; selecting a first mounting location on the airflow assembly for mounting a first end of the flexible sound suppressor tube and selecting a second mounting location on the airflow assembly for mounting a second end of the flexible sound suppressor tube based on the location and frequency of the target sound; and mounting the first end of the flexible sound suppressor tube to a first aperture of the airflow assembly at the first mounting location and mounting the second end of the flexible sound suppressor tube to a second aperture of the airflow assembly at the second mounting location to permit airflow of the airflow assembly to pass through the airflow passageway and suppress the target sound.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
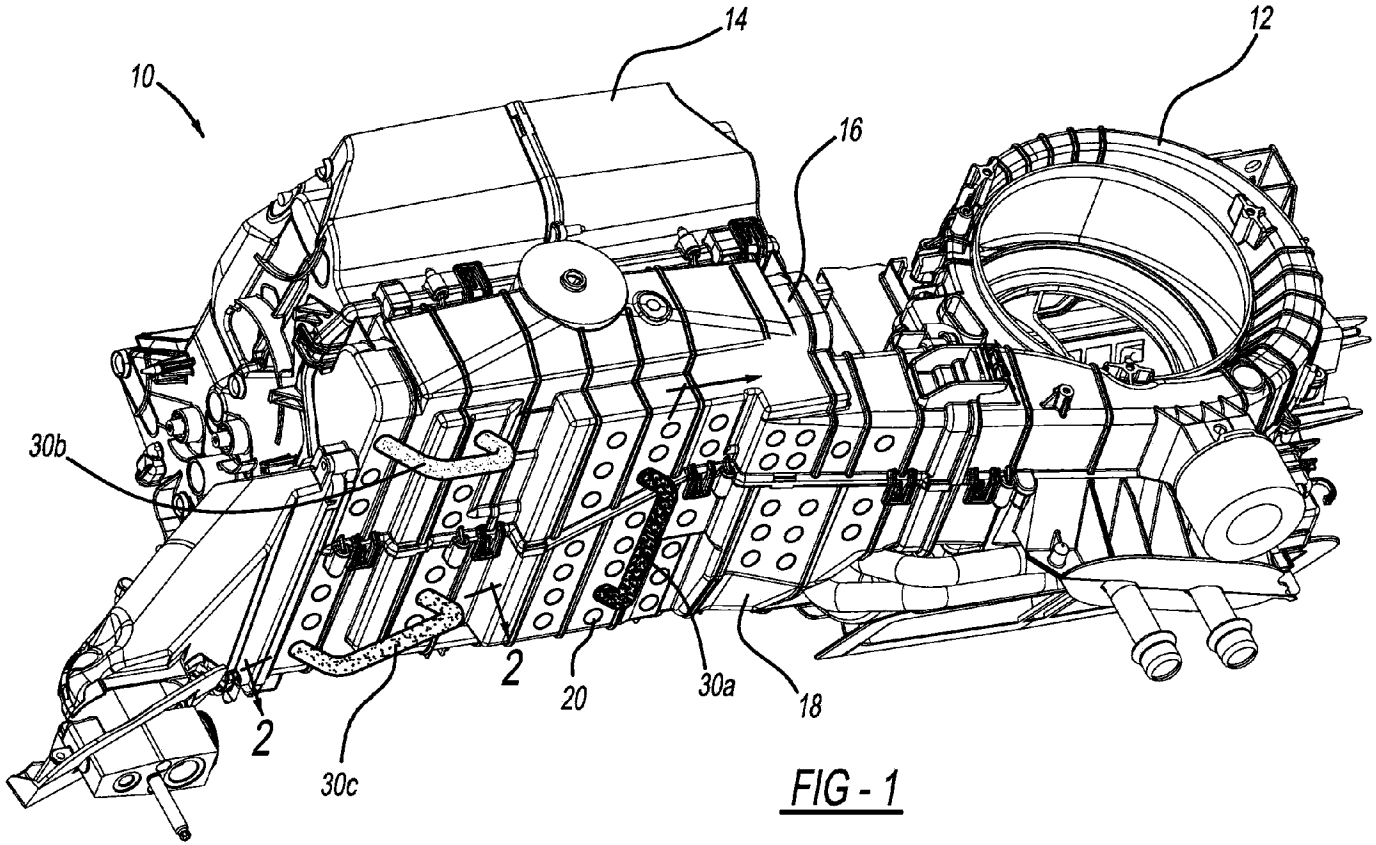
FIG. 1 is a perspective view of a heating, ventilation, and air cooling (HVAC) assembly according to the present teachings.

With initial reference to FIG. 1, a heating, ventilation, and air cooling (HVAC) assembly according to the present teachings is illustrated at reference numeral 10. The HVAC assembly 10 includes a blower subassembly 12 and an HVAC subassembly 14. The HVAC subassembly 14 includes an evaporator and a heater core (not specifically shown). A plenum chamber 16 is between, and generally connects, the blower subassembly 12 and the HVAC subassembly 14. The plenum chamber 16 can be made of any suitable material, such as a suitable polymeric material. The blower subassembly 12 and the HVAC subassembly 14 can also be made of a polymeric material, and can include other materials as well, such as any suitable metallic material.

The HVAC assembly 10 includes an outer wall 18 having a plurality of weakened sections or portions 20. As illustrated, the weakened sections 20 are circular, but can by any suitable shape and size. The weakened sections 20 can have any suitable configuration to allow one or more of them to be removed, so as to define an aperture extending through the outer wall 18, such as first and second apertures 22 and 24 described herein. For example, the weakened sections 20 can be perforated portions of the outer wall 18.

The weakened sections 20 can be at any suitable location about the HVAC assembly 10. For example, the weakened sections 20 can be at the blower subassembly 12, the HVAC subassembly 14, the plenum chamber 16, or at any other suitable location of the HVAC assembly 10, such as at any other internal or external wall thereof, or any internal surface. With continued reference to FIG. 1 and additional reference to FIG. 2, two weakened sections 20 can be removed to provide a first aperture 22 and a second aperture 24 (FIG. 2) extending through the outer wall 18 of the HVAC assembly 10.

One or more shunts 30 can be mounted to the outer wall 18. As illustrated in FIG. 1 for example, three shunts 30*a*-30*c* can be mounted to the outer wall 18. Each one of the shunts 30*a*-30*c* extend between two apertures defined by the outer wall 18 upon removal of weakened sections 20, such as the first and the second apertures 22 and 24. The shunts 30*a*-30*c* can be arranged at any suitable orientation in order to suppress a target noise or tone, such as hollow tones between about 500 and 1500 Hz. Each one of the shunts 30*a*-30*c* can have any length, width, internal diameter, or any other dimension suitable for suppressing a target sound. The shunts 30 can be located at any suitable location about the HVAC assembly 10, such as anywhere on or within the blower assembly 12, the HVAC subassembly 14, or the plenum chamber 16. The shunts 30 can also be located in any airflow duct, such as any airflow duct leading to the passenger cabin. The shunts 30 can be provided in the defroster nozzle as well. The shunts 30 can further be used at any location throughout a vehicle, and with non-vehicle applications. For example, the shunts 30 can be used with any airflow system, such as a building airflow system.

The shunts 30 can be made of any suitable material, such as a compliant material. Suitable compliant materials include, but are not limited to, any suitable rubber material, polymeric material, or flexible metallic material. An exemplary suitable flexible material includes Tygone™ by Saint-Gobain Performance SA. of France.

The shunts 30*a*-30*c* can be selected from a plurality of different shunts 30 having various dimensions, such as various different lengths, widths, internal diameters, etc. The plurality of shunts 30 available for selection can be color coded or include any visually distinguishable markings (as illustrated in FIG. 1) according to any particular dimension in order to facilitate selection thereof. For example, relatively long shunts 30 can have a first color, relatively short shunts 30 can have a second color, and shunts 30 with an intermediate length can have a third color.

Figure 2:
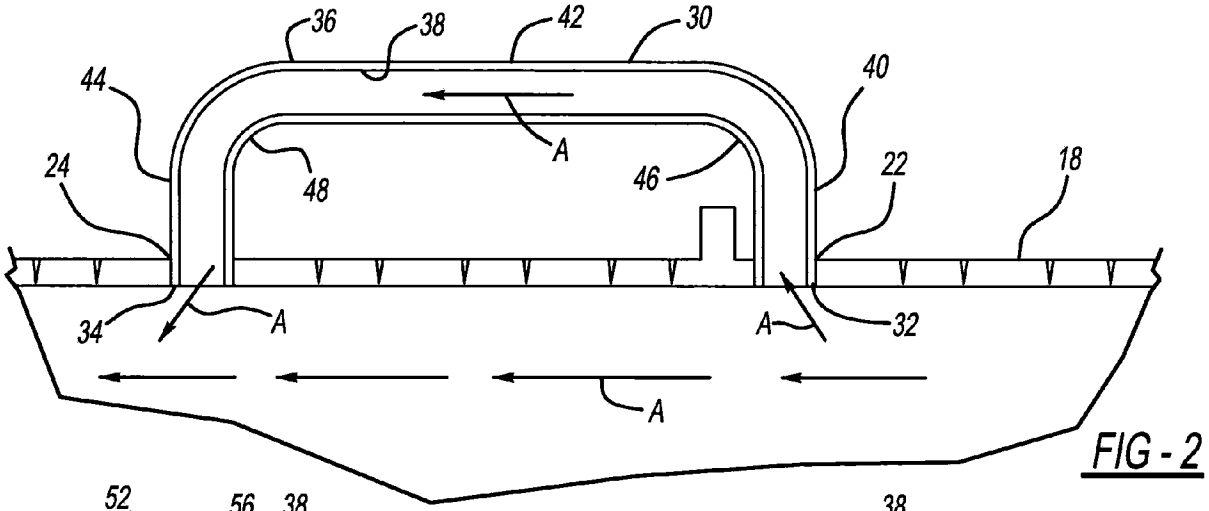
FIG. 2 is a cross-sectional view taken along line 2-2 of FIG. 1.

As illustrated in FIG. 2, each shunt 30, such as shunts 30*a*-30*c*, can include a first end 32 and a second end 34, which is opposite to the first end 32. Between the first end 32 and the second end 34 is a body portion 36. The body portion 36 defines a passageway 38, which extends from the first end 32 to the second end 34. The body portion 36 is generally an elongated portion and includes a first portion 40, a second portion 42, and a third portion 44. Between the first portion 40 and the second portion 42 is a first curved portion 46. Between the second portion 42 and the third portion 44 is a second curved portion 48. The shunts 30 are generally U-shaped, as illustrated in FIGS. 1 and 2. The shunts 30 can have any suitable shape, however, in order to permit passage of airflow therethrough. The shunts 30 can have any suitable regular or irregular shape. The shunts 30 may also be configured such that the passageway 38 has any suitable diameter in order to suppress a target tone. The shunts 30 can have any effective length measured between the first end 32 and the second end 34 sufficient to attenuate one or more undesirable frequencies, tones, and/or frequency bands.

As illustrated in FIG. 2, the first end of the shunt 30 is coupled to the outer wall 18 at the first aperture 22, and the second end 34 is coupled to the outer wall 18 at the second aperture 24. As a result, airflow A flowing through the HVAC assembly 10 can pass into the passageway 38 of the shunt 30 at the first end 32, travel through the passageway 38 to the second end 34, and exit the passageway 38 at the second end 34 where the airflow A passes back through the outer wall 18 and into the HVAC assembly 10.

The shunt 30 can be coupled to the outer wall 18 at the first and second apertures 22 and 24 in any suitable manner. For example, the first and second ends 32 and 34 can be attached within the first and second apertures 22 and 24 respectively with a suitable adhesive. With additional reference to FIG. 3, the first end 32 or the second end 34 can be secured at the outer wall 18 with a separate coupling member 50. The coupling member 50 includes a first end 52 and a second end 54, which is opposite to the first end 52. The coupling member 50 defines a through bore 56 extending through the coupling member 50 from the first end 52 to the second end 54. Proximate to the first end 52 are one or more retention members 58, which can be formed as teeth extending outward from the coupling member 50. Proximate to the second end 54, the coupling member 50 can include one or more second retention members or flanges 60, which also extend outward from the coupling member 50.

Figure 3:
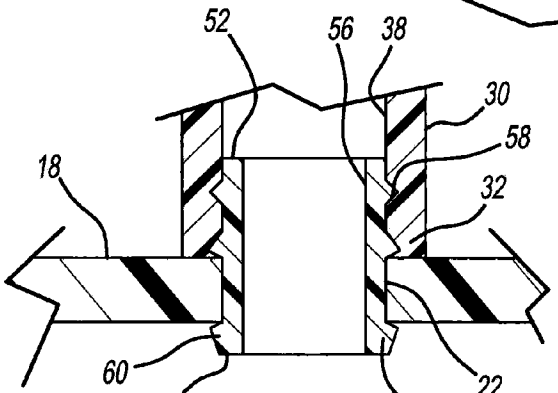
FIG. 3 is a cross-sectional view of cooperation between a first end of a sound suppressor shunt according to the present teachings coupled to an outer wall of the HVAC assembly at an aperture defined by the HVAC assembly.

The coupling member 50 can be seated in the first aperture 22 (as illustrated in FIG. 3) and/or the second aperture 24, for example, and coupled thereto by inserting the coupling member 50 into the first or second apertures 22/24 such that the outer wall 18 is between the first and second retention members 58 and 60. The shunt 30 is seated over the coupling member 50 such that the first end 52 of the coupling member 50 extends into the passageway 38 of the shunt 30. The first retention members 58 cooperate with an interior surface of the shunt 30 at the passageway 38 to secure the shunt 30 to the coupling member 50.

Figure 4:
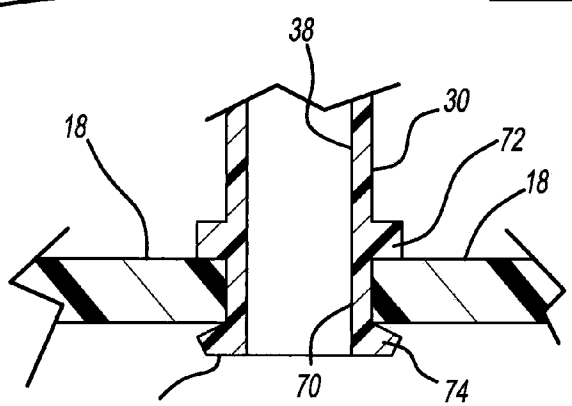
FIG. 4 is an additional cross-sectional view of the sound suppressor shunt according to the present teachings coupled to the HVAC assembly.

With additional reference to FIG. 4, the shunt 30 can be directly attached to the outer wall 18 without an adhesive or separate coupling member. As illustrated in FIG. 4, the shunt 30 can include a first retention member or flange 72 and a second retention member or flange 74. The first and second retention members 72 and 74 provide the shunt 30 with a coupling portion 70, which can be at the first end 32 and/or the second end 34 of the shunt 30. The first and second retention members 72 and 74 can be formed integral with the shunt 30. The shunt 30 can be arranged such that the outer wall 18 is between the first and second retention members 72 and 74 in order to couple the shunt 30 to the outer wall 18 at the first and/or second aperture 22 and 24. In addition to the coupling portion 70, the shunt 30 can have any suitable coupling member at the first and second ends 32 and 34, such as a bulbous connector, or a flexible cab. The shunt 30 can also be welded to the outer wall 18 at the first and second apertures 22 and 24.

Although the shunts 30 have been described herein in conjunction with HVAC assembly 10, the shunts 30 can be used with any suitable device, component, or part, and in conjunction with any method or application to suppress undesirable sounds and tones, including those between 500 and 1500 hertz.

Selection and arrangement of one or more of the shunts 30 will depend on the specific target sound or tone that is desired to be suppressed. Upon identification of the target tone, the particular location and orientation of one or more shunts 30 necessary to suppress the tone will be determined. The shunts 30 can be positioned at any suitable location and position about the HVAC assembly 10, including in the duct work of the HVAC assembly 10. For example and with reference to FIG. 1, suppression of a particular target tone may call for vertical placement of the first shunt 30*a*, and horizontal placement of both the second and third shunts 30*b* and 30*c*. Suppression of the target tone may call for the second and third shunts 30*b* and 30*c* to be arranged at an angle with respect to one another, such that they do not extend parallel to one another. Furthermore, suppression of the target tone may call for any one of the shunts 30*a*-30*c* to be longer or shorter than the others. For example, the second shunt 30*b* can be shorter than each of the first and third shunts 30*a* and 30*c*.

After the arrangement of the shunts 30*a*-30*c* necessary to suppress the target tone is determined, the weakened sections 20 corresponding to the positions of the shunts 30 can be identified and removed in order to expose apertures within the outer wall 18 to which the shunts can be coupled, such as the first aperture 22 and the second aperture 24. The shunts 30*a*-30*c* can then be mounted at the apertures, such as the first and second apertures 22 and 24, in any suitable manner, such as with an adhesive, a coupling member 50, or the coupling portion 70. The shunts 30 suppress the target tone in a variety of different ways, such as by allowing the target tone to radiate out from within the HVAC assembly 10 at the shunts 30.

The shunts 30 can be provided during assembly of the HVAC assembly 10, for example, or at any other suitable time. The shunts 30 can be applied after the HVAC assembly 10 has been installed in a vehicle, such as a prototype vehicle. Therefore, if undesirable tones are detected after the HVAC assembly 10 has been installed, action can be taken to suppress a tone without removing the HVAC assembly 10 or parts thereof by coupling the shunts 30 with the installed HVAC assembly 10 as described herein.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An airflow sound suppressor for a heating, ventilation and air cooling (HVAC) assembly, the airflow sound suppressor comprising:

a first end of the sound suppressor configured to be mounted to a first surface;

a second end of the sound suppressor configured to be mounted to a second surface; and an elongated portion extending between the first end and the second end, the elongated portion defining a passageway therethrough extending an entire length of the sound suppressor; wherein the first and the second mounting surfaces are selected from a plurality of mounting surfaces at an exterior surface of the HVAC assembly defined by a plurality of weakened portions of the exterior surface.

2. The sound suppressor of claim 1, wherein the elongated portion is a flexible tube.

3. The sound suppressor of claim 1, wherein the elongated portion is generally U-shaped.

4. The sound suppressor of claim 1, further comprising retention members at both the first end and the second end configured to secure the sound suppressor to the HVAC assembly.

5. The sound suppressor of claim 1, further comprising a coupling member configured to couple with both the HVAC assembly and the sound suppressor to connect the sound suppressor to the HVAC assembly.

6. The sound suppressor of claim 1, wherein the elongated portion is sized and shaped to accommodate airflow therethrough and to suppress tones in the range of 500 Hz to 1,500 Hz.

7. The sound suppressor of claim 1, wherein the sound suppressor is color coded to distinguish it from other sound suppressors having different dimensions.

8. A sound suppressor for a heating, ventilation, and air cooling (HVAC) assembly comprising:

a first end of the sound suppressor mounted to the HVAC assembly at a first aperture in a first mounting surface defined by the HVAC assembly;

a second end of the sound suppressor mounted to the HVAC assembly at a second aperture in a second mounting surface defined by the HVAC assembly spaced apart from the first aperture; and a flexible elongated portion extending from the first end to the second end, the flexible elongated portion defining a passageway therethrough extending an entire length of the sound suppressor; wherein the first and the second mounting surfaces are selected from a plurality of mounting surfaces at an exterior surface of the HVAC assembly defined by a plurality of weakened portions of the exterior surface.

9. The sound suppressor of claim 8, wherein the elongated portion includes a first curved portion and a second curved portion.

10. The sound suppressor of claim 8, wherein the sound suppressor is a flexible tube.

11. The sound suppressor of claim 8, further comprising a first retention member at the first end and a second retention member at the second end, the first and the second retention members couple the sound suppressor to the HVAC assembly.

12. A method for suppressing a target sound of an airflow assembly comprising:

selecting a flexible sound suppressor tube defining an airflow passageway from a plurality of flexible sound suppressor tubes having different dimensions based on location and frequency of the target sound to be suppressed;

selecting a first mounting location on the airflow assembly for mounting a first end of the flexible sound suppressor tube and selecting a second mounting location on the airflow assembly for mounting a second end of the flexible sound suppressor tube based on the location and frequency of the target sound; and mounting the first end of the flexible sound suppressor tube to a first aperture of the airflow assembly at the first mounting location and mounting the second end of the flexible sound suppressor tube to a second aperture of the airflow assembly at the second mounting location to permit airflow of the airflow assembly to pass through the airflow passageway and suppress the target sound; wherein the airflow assembly is a heating, ventilation and air cooling (HVAC) assembly; and the first and the second mounting locations are selected from a plurality of mounting locations at an exterior surface of the HVAC assembly defined by a plurality of weakened portions of the exterior surface.

13. The method of claim 12, wherein the plurality of flexible sound suppressor tubes have different lengths.

14. The method of claim 12, further comprising removing a first weakened portion of the plurality of weakened portions at the first mounting location to open the first aperture, and removing a second weakened portion of the plurality of weakened portions at the second mounting location to open the second aperture.

15. The method of claim 12, further comprising mounting the first end of the flexible sound suppressor tube to the first aperture with a first coupling member and mounting the first end of the flexible sound suppressor tube to the first aperture with a second coupling member.

* * * * *